US007832239B2

(12) United States Patent
Kozuka et al.

(10) Patent No.: US 7,832,239 B2
(45) Date of Patent: Nov. 16, 2010

(54) LOCK APPARATUS FOR A GLOVE BOX OF A VEHICLE

(75) Inventors: Akihiko Kozuka, Aichi-ken (JP); Toshi Saeki, Toyota (JP)

(73) Assignee: Kojima Press Industry Co., Ltd., Toyota-shi (JP)

( * ) Notice: Subject to any disclaimer, the term of this patent is extended or adjusted under 35 U.S.C. 154(b) by 265 days.

(21) Appl. No.: 11/795,386

(22) PCT Filed: Jan. 18, 2005

(86) PCT No.: PCT/JP2005/000812

§ 371 (c)(1),
(2), (4) Date: Jul. 17, 2007

(87) PCT Pub. No.: WO2006/077644

PCT Pub. Date: Jul. 27, 2006

(65) Prior Publication Data

US 2007/0289345 A1 Dec. 20, 2007

(51) Int. Cl.
*B65D 55/14* (2006.01)

(52) U.S. Cl. ..... 70/162; 70/208; 292/39; 292/41; 292/DIG. 37; 296/24.34; 296/37.12

(58) Field of Classification Search ..... 70/208, 70/159–162, 190; 296/24.34, 37.8, 37.12, 296/37.1; 292/39, 41, DIG. 37
See application file for complete search history.

(56) References Cited

U.S. PATENT DOCUMENTS 2,587,583 A * 3/1952 Allen et al. ..... 292/216
2,603,963 A * 7/1952 Allen ..... 70/266
2,759,351 A * 8/1956 Allen ..... 70/141
3,044,287 A * 7/1962 Pelcin ..... 70/99
4,864,835 A * 9/1989 Wartian ..... 70/107
5,741,040 A * 4/1998 Gebauer et al. ..... 296/97.2
6,006,558 A * 12/1999 Peters ..... 70/63
7,036,852 B2 * 5/2006 Cho ..... 292/33
7,156,440 B2 * 1/2007 Katagiri ..... 296/37.12
7,182,373 B2 * 2/2007 Yamada ..... 292/32
7,475,929 B2 * 1/2009 Yamada ..... 296/24.34
7,523,975 B2 * 4/2009 Chaloupka et al. ..... 296/37.1
2006/0055196 A1 * 3/2006 Yamada ..... 296/37.12

(Continued)

FOREIGN PATENT DOCUMENTS

JP 58-75055 U1 5/1983

(Continued)

*Primary Examiner*—Lloyd A Gall
(74) *Attorney, Agent, or Firm*—Kenyon & Kenyon LLP

(57) ABSTRACT

A lock apparatus for locking a glove box that is rotatably coupled to an instrument panel of a vehicle. The lock apparatus includes an operating portion with a push-type knob, a pair of lock portions, and a transmitting portion with a transmitting member. The operating portion is located closer to a driver seat than a right and left center of the glove box in a right and left direction of a vehicle. The operating portion is coupled to the instrument panel between the instrument panel and the glove box. Each of the lock portions is located at each of right and left end portions of the glove box. The transmitting portion transmits a motion of the operating portion to each of the pair of lock portions using tension and/or compression of the transmitting member.

1 Claim, 6 Drawing Sheets

U.S. PATENT DOCUMENTS

| | | | | |
|---|---|---|---|---|
| 2008/0022730 | A1 * | 1/2008 | Dietrich et al. | 70/158 |

FOREIGN PATENT DOCUMENTS

| | | | |
|---|---|---|---|
| JP | S60-195450 | | 12/1985 |
| JP | 01-146087 | | 6/1989 |
| JP | 02-45265 | U1 | 3/1990 |
| JP | 04-060079 | A | 2/1992 |
| JP | 05-338500 | | 12/1993 |
| JP | 06-146683 | A | 5/1994 |
| JP | 07-82941 | A | 3/1995 |
| JP | 07-030435 | Y2 | 7/1995 |
| JP | 2776148 | B2 | 7/1998 |
| JP | 2003-013647 | A | 1/2003 |
| JP | 2003-013655 | A | 1/2003 |
| JP | 2004-211386 | A | 7/2004 |
| JP | 2006-044506 | A | 2/2006 |
| WO | WO 2006/030610 | A | 3/2006 |

* cited by examiner

LOCK APPARATUS FOR A GLOVE BOX OF A VEHICLE

This is a 371 national phase application of PCT/JP2005/000812 filed 18 Jan. 2005, the content of which is incorporated herein by reference.

TECHNICAL FIELD

The present invention relates to a lock apparatus. More specifically, the present invention relates to a lock apparatus for locking an opening and closing motion of a glove box of a vehicle.

BACKGROUND

A lock apparatus for a glove box which is coupled to an instrument panel of a vehicle so as to be able to be open and closed is disclosed in Japanese Patent Publication 2003-13647 and Japanese Patent Publication 2003-13655.

Japanese Patent Publication 2003-13647 discloses that a knob (an operating handle) is located at a center of a glove box, that the knob is provided not to an instrument panel but to the glove box, and that the knob is of a rotation type (not of a push type).

Japanese Patent Publication 2003-13655 also discloses that a knob (an operating handle) is located at a center of a glove box, that the knob is provided not to an instrument panel but to the glove box, and that the knob is of a rotation type (not of a push type).

With Japanese Patent Publication 2003-13647 and Japanese Patent Publication 2003-13655, there are the following drawbacks:

(a) Since the knob is located at the center of the glove box, the knob is located relatively far from a driver seat. As a result, an operability of the knob from the driver seat is poor.

(b) Since the knob is of a rotation type, a recess for inserting a finger may be required to be provided beneath and at a rear of the knob, which degrades the appearance of the glove box. Further, a door thickness of the glove box is rather large, which reduces the housing space of the glove box.

(c) If the knob provided to the glove box is changed from one of the rotation type to one of a push type in order to decrease the drawback of item (b) above, an open direction of the glove box becomes reverse to the push direction of the knob, which lowers the opening operability of the glove box.

(d) If the knob is offset to one of the ends of the glove box in the right and left directions of the glove box in order to decrease the drawback of item (a) above, when the knob is operated or the glove box is closed, a load is imposed on the one end of the glove box thereby causing a deformation of the glove box. As a result, a step and a clearance are generated between a surface of at least the one end of the glove box in the right and left direction of the glove box and a surface of the instrument panel, which degrades the appearance of the glove box.

(e) In order to decrease the drawback of item (d) above, if a lock portion is provided at each end of the glove box in the right and left direction of the glove box and the knob is offset to one of the ends of the glove box in the right and left directions to lock and unlock the lock portions, due to a torsion generated in an operation force transmitting member extending between the right and left lock portions, the right and left lock portions do not operate synchronously. As a result, one side locking, where only one lock portion is locked, and the other lock portion is not locked is likely to take place, which will increase a deformation of the glove box. If a torsional rigidity of the operation force transmitting member is increased, a cross section of the operation force transmitting member is large, so that the housing space of the glove box is small.

Problems to be solved by certain embodiments of the present invention can be the poor operability of the knob when the knob is located at the center of the glove box, the poor appearance of the glove box when the knob is of a rotation type, the poor opening operability of the glove box when the knob provided to the glove box is changed to of the push type, the generation of the step between the door and the instrument panel (or a fixed interior member of a vehicle, hereinafter the instrument panel includes the fixed interior member) when the knob is offset to one end of the glove box in the right and left directions of the glove box, and the one side locking which will take place when the lock portions are provided at opposite ends of the glove box in the right and left direction of the glove box wherein the right and left lock portions are unlikely to operate synchronously due to a torsion of the operating force transmitting member.

An object of certain embodiments of the present invention can be to provide a lock apparatus for locking an opening and closing motion of a glove box of a vehicle which can perform all of improving operability of a knob from a driver seat, improving an appearance of a portion of the glove box around the knob, maintaining the opening operability of the glove box even when the knob is changed to that of a push type, preventing a step from being caused between a door and an instrument panel even when the knob is offset to one end of the glove box in a right and left direction of the glove box, and preventing one side locking due to a torsion of an operating force transmitting member extending between right and left lock portions from taking place even when the lock portions are provided at opposite ends of the glove box in the right and left direction of the glove box.

BRIEF SUMMARY

Certain embodiments of the present invention may perform the above objects as follows:

The following items (1)-(4) may be applicable to all embodiments of the present invention.

(1) The present invention is a lock apparatus for locking an opening and closing motion of a glove box. The glove box is rotatably coupled to an instrument panel of a vehicle. The apparatus is adapted to lock and unlock rotation of the glove box to and from the instrument panel when the glove box is at a closed position.

The apparatus includes an operating portion with a push-type knob, a pair of lock portions, and a transmitting portion with a transmitting member.

The operating portion is located closer to a driver seat than a right and left center of the glove box in a right and left direction of a vehicle. The operating portion is coupled to the instrument panel between the instrument panel and the glove box.

Each of the lock portions is located at each of right and left end portions of the glove box.

The transmitting portion is adapted to transmit a motion of the operating portion to each of the pair of lock portions using tension and/or compression of the transmitting member.

(2) In the lock apparatus according to item (1) above, the operating portion includes the push-type knob, an operating piece movable in a plane perpendicular to a movement of the knob, and an exchanging portion for exchanging the movement of the knob to a movement of the operating piece.

(3) In the lock apparatus according to item (1) above, each of the pair of lock portions includes:

a lock female portion provided to one of the glove box and the instrument panel; and a lock male portion provided to the other of the glove box and the instrument panel. The lock male portion is adapted to move linearly relative to the lock female portion.

(4) The lock apparatus according to item (1) above further includes a key device provided adjacent the operating portion so as to be able to enter a locus of movement of the knob. The key device is adapted to stop a push motion of the knob when the key device enters the locus of the movement of the knob.

The following item (5) may be applicable to Embodiments 1-4 of the present invention.

(5) In a lock apparatus according to item (1) above, the operating portion includes an operating piece movable in a plane perpendicular to a movement of the knob. The transmitting portion is adapted to transmit a motion of the operating piece of the operating portion to each of the pair of lock portions synchronously relative to each other.

The following items (6)-(9) can be applicable to Embodiment 1 of the present invention.

(6) In a lock apparatus according to item (5) above, the transmitting portion is supported by the glove box between the instrument panel and the glove box.

(7) In a lock apparatus according to item (5) above, the transmitting portion includes:

a first rod supported by the glove box and extending in a right and left direction of the glove box;

a second rod supported by the glove box and extending in the right and left direction of the glove box; and a gear engaging the first rod and the second rod and driving synchronously the first rod and the second rod in opposite directions to each other.

(8) In a lock apparatus according to item (5) above, each of the pair of lock portions includes a lock male portion and a lock female portion. The lock male portion of each of the pair of lock portions is supported by the glove box between the instrument panel and the glove box.

(9) In a lock apparatus according to item (7) above, each of the pair of lock portions includes a lock male portion and a lock female portion. The lock male portion of the lock portion is formed at each of an end of the first rod and an end of the second rod of the transmitting portion. The lock female portion of the lock portion is formed at each of portions of the instrument panel opposing the end of the first rod and the end of the second rod of the transmitting portion in the right and left direction of the glove box.

The following items (10)-(13) can be applicable to Embodiment 2 and Embodiment 3 of the present invention.

(10) In a lock apparatus according to item (5) above, the transmitting portion is supported by the instrument panel between the instrument panel and glove box.

(11) In a lock apparatus according to item (5) above, the transmitting portion includes a connecting rod extending in a right and left direction of the instrument panel.

(12) In a lock apparatus according to item (5) above, each of the pair of lock portions includes a lock male portion and a lock female portion. The lock male portion of each of the pair of lock portions is supported by the instrument panel between the instrument panel and the glove box. The lock male portion of each of the pair of lock portions includes a lock casing and a lock engaging piece slidably supported by the lock casing.

(13) In a lock apparatus according to item (11) above, each of the pair of lock portions includes a lock male portion and a lock female portion. The connecting rod of the transmitting portion connects a lock male portion of one of the pair of lock portions and a lock male portion of the other of the pair of lock portions.

The following item (14) can be applicable to Embodiment 2 of the present invention.

(14) In a lock apparatus according to item (11) above, the operating piece of the operating portion is slidably supported by the instrument panel so as to be movable linear in opposite directions in right and left direction of the glove box. One end of the operating piece is connected to a lock male portion of a lock portion located closer to the operating portion between the pair of lock portions.

The following item (15) is applicable to Embodiment 3 of the present invention.

(15) In a lock apparatus according to item (5) above, the operating piece of the operating portion is pivotally supported by the instrument panel so that one end of the operating piece is movable in opposite directions in right and left direction of the glove box. The one end of the operating piece is connected via the transmitting portion to a lock male portion of a lock portion located closer to the operating portion between the pair of lock portions.

The following items (16)-(23) may be applicable to Embodiment 4 of the present invention.

(16) In a lock apparatus according to item (5) above, a motion of the operating piece of the operating portion is rotation in the plane perpendicular to a movement of the knob.

(17) In a lock apparatus according to item (5) above, the transmitting portion is provided to the instrument panel between the instrument panel and the glove box.

(18) In a lock apparatus according to item (5) above, the transmitting portion includes a double wire including a first wire and a second wire.

(19) In a lock apparatus according to item (17) above, the first wire of the double wire is connected to a first lock portion of the pair of lock portions. The first wire extends from the first lock portion to the operating piece where the first wire is connected to the operating piece, and further extends from the operating piece to a second lock portion of the pair of lock portions where the first wire is connected to the second lock portion. The second wire of the double wire is connected to the second lock portion of the pair of lock portions. The second wire extends from the second lock portion to the operating piece where the second wire is connected to the operating piece, and further extends from the operating piece to the first lock portion of the pair of lock portions where the second wire is connected to the first lock portion. When the lock piece is rotated, a tension force is loaded on the first wire in one direction and another tension force is loaded on the second wire in the other direction.

(20) In a lock apparatus according to item (19) above, a tension force adjusting portion for adjusting the tension force of the first wire of the double wire and the tension force of the second wire of the double wire and equalizing the tension force of the first wire and the tension force of the second wire, is provided to the operating piece.

(21) In a lock apparatus according to item (20) above, the tension force adjusting portion includes an aperture formed in the operating piece between the first wire and the second wire of the double wire and a tapered member inserted into the aperture. The aperture is larger in size than the tapered member in a direction where the tapered member is held between the first wire and the second wire so that the tapered member is movable in the aperture in the direction where the tapered member is held between the first wire and the second wire.

(22) In a lock apparatus according to item (5) above, each of the pair of lock portions includes a lock male portion and a lock female portion. The lock male portion of each of the pair of lock portions is supported by the instrument panel between the instrument panel and the glove box.

(23) In a lock apparatus according to item (22) above, the lock male portion of each of the pair of lock portions includes a lock casing, a rotational member rotatably supported by the lock casing, and a lock engaging piece axially slidable to the lock casing.

The following items (24)-(30) can be applicable to Embodiment 5 of the present invention.

(24) In a lock apparatus according to item (1) above, the operating portion includes an operating piece movable in a plane perpendicular to a movement of the knob. The transmitting portion is adapted to transmit a motion of the operating piece of the operating portion to each of the pair of lock portions allowing a transmission asynchronous to each other.

(25) In a lock apparatus according to item (24) above, a motion of the operating piece of the operating portion is a linear reciprocal motion perpendicular to a movement of the knob.

(26) In a lock apparatus according to item (24) above, the transmitting portion is provided to the instrument panel between the instrument panel and the glove box.

(27) In a lock apparatus according to item (24) above, the transmitting portion includes two single wires, each of the single wires connecting each of the pair of lock portions and the operating piece of the operating portion.

(28) In a lock apparatus according to item (27) above, each of the pair of lock portions includes a lock male portion and a lock female portion. The lock male portion of each of the pair of lock portions is supported by the instrument panel between the instrument panel and the glove box.

(29) In a lock apparatus according to item (28) above, each of the pair of lock portions includes:

a lock casing;

an intermediate member supported by the lock casing so as to be linearly slidable in opposite directions and having an inclined groove; and a lock engaging piece having a pin engaging the inclined groove of the intermediate member and moving in a direction to and away from the glove box when the intermediate member is moved linearly in opposite directions relative to the lock casing.

(30) In a lock apparatus according to item (29) above, the single wire is connected to the intermediate member of each of the pair of lock portions so that when the knob of the operating portion is pushed and the operating piece is pulled, the wire pulls the intermediate member of the lock portion and pulls the lock engaging piece of the lock portion in a direction away from the glove box, thereby releasing a lock state of the glove box by the lock portion.

According to the lock apparatus according to item (1) above, the following technical advantages can be obtained in all Embodiments 1-5 of the present invention:

(a) Since the knob is disposed at a portion of the instrument panel closer to the driver seat than the center of the glove box in the right and left direction of the glove box, an operability of the knob by a driver from the driver seat is good.

(b) Since the knob is not of a rotation type but of a push type, a recess for inserting a finger is not required to be provided in the glove box at a rear of the knob. As a result, the appearance is good. Further, a thickness of a door of the glove box can be small so that a housing space inside the glove box can be large.

(c) Since the knob is provided to the instrument panel, the push direction of the knob and the opening direction of the glove box are not reverse so that the opening operability of the glove box is good.

(d) Since the lock portions are provided so as to correspond to the right and left end portions of the glove box, when the glove box is closed, a step between the glove box and the instrument panel, which would take place due to a deformation of the glove box if the glove box was pushed at only one end of the glove box in the right and left direction of the glove box, is not caused.

(e) Since the transmitting member for transmitting an operating force between the right and left lock portions uses the tension and/or compression of the transmitting member, a torsion is not generated in the operating force transmitting member, so that motions of the right and left lock portions are synchronized. As a result, notwithstanding the lock portion is provided at each of the right and left ends of the glove box, one side locking of the lock portion due to a torsion of the operating force transmitting member between the right and left lock portions can be prevented.

According to the lock apparatus according to item (2) above, since the operating portion is provided with the exchanging portion for exchanging the movement of the knob to a movement of the operating piece, a push motion of the knob can be easily exchanged to a movement of the operating piece.

According to the lock apparatus according to item (3) above, since the lock portion includes the lock female portion and the lock male portion which moves linearly relative to the lock female portion, a motion of the operating force transmitting member can be exchanged to a motion of the lock male portion of the lock portion.

According to the lock apparatus according to item (4) above, since the key device having a stopper for stopping a push motion of the knob is further provided adjacent the operating portion, goods housed in the glove box can be prevented from being stolen.

According to the lock apparatus according to item (5) above, the following technical advantage may be obtained in Embodiments 1-4 of the present invention.

More particularly, since the transmitting portion is adapted to transmit a motion of the operating piece of the operating portion to each of the pair of lock portions synchronously relative to each other, locking and/or unlocking of the pair of lock portions synchronize to each other, so that one side locking does not occur and a step generated due to the one side locking between the glove box and the instrument panel is not caused.

According to the lock apparatus according to items (6)-(9), the following technical advantages can be obtained in Embodiment 1 of the present invention:

More particularly, according to the lock apparatus according to item (6) above, since the transmitting portion is supported by the glove box, a motion of the operating piece of the operating portion can be transmitted to a movement of the transmitting member and then to a movement of the lock male portion of the lock portion maintaining the direction of the motions, i.e., without changing the direction of the motions. As a result, the structures of the transmitting portion and the lock portion are simplified.

According to the lock apparatus according to item (7) above, since the transmitting portion includes the first rod, the second rod and the gear, the first rod and the second rod can easily be driven synchronously to each other and in opposite directions to each other in the right and left direction.

According to the lock apparatus according to item (8) above, since the lock male portion of the lock portion is supported by the glove box, a movement of the transmitting member supported by the glove box can be transmitted to a movement of the lock male portion as it is without changing the direction. As a result, the structures of the transmitting portion and the lock portion are simplified.

According to the lock apparatus according to item (9) above, since the lock male portions are formed at the end of the first rod and the end of the second rod, a movement of the transmitting member is transmitted to a movement of each lock male portion as it is.

According to the lock apparatus according to items (10)-(13) above, the following technical advantages are obtained in Embodiments 2 and 3 of the present invention:

More particularly, according to the lock apparatus according to item (10) above, since the transmitting portion is supported by the instrument panel, the structure of the glove box can be simplified as compared with a case where the transmitting portion is supported by the glove box. Further, the housing space of the glove box can be large.

According to the lock apparatus according to item (11) above, since the transmitting member of the transmitting portion includes a connecting rod extending in the right and left direction of the instrument panel, the right and left lock portions can be operated synchronously by causing the connecting rod to stroke in the right and left direction.

According to the lock apparatus according to item (12) above, since the lock male portion includes the lock casing and the lock engaging piece, locking and unlocking the lock portion can be conducted by moving the lock engaging piece.

According to the lock apparatus according to item (13) above, since the connecting rod connects the lock male portions of the right and left lock portions, locking and unlocking the right and left lock portions can be conducted by moving the connecting rod.

According to the lock apparatus according to item (14), the following technical advantage can be obtained in Embodiment 2 of the present invention:

More particularly, since the operating piece of the operating portion is connected to the lock male portion of the lock portion located closer to the operating portion between the pair of lock portions, locking and unlocking the lock portion can be conducted by pushing the knob to move the operating piece using a small number of members.

According to the lock apparatus according to item (15) above, the following technical advantage can be obtained in Embodiment 3 of the present invention:

More particularly, though the operating piece is a pivotally supported piece, the operating piece can drive the transmitting member linearly by exchanging the pivotal motion to a linear reciprocating motion.

According to the lock apparatus according to items (16)-(23) above, the following technical advantages may be obtained in Embodiment 4 of the present invention:

More particularly, according to the lock apparatus according to item (16) above, since a motion of the operating piece of the operating portion is rotation in the plane perpendicular to a movement of the knob, the push motion of the knob can be exchanged to a pull or a pull motion of the double wire of the transmitting portion via the operating piece.

According to the lock apparatus according to item (17) above, since the transmitting portion is provided to the instrument panel, a structure of the glove box can be simplified as compared with a case where the transmitting portion is provided to the glove box, so that the housing space in the glove box can be wide.

According to the lock apparatus according to item (18) above, since the transmitting portion includes the double wire including the first wire and the second wire, the right and left lock portions can be operated synchronously to each other notwithstanding the transmitting member is constructed of a wire.

According to the lock apparatus according to item (19) above, since a tension directed in one direction acts on the first wire and a tension direction in the other direction acts of the second wire, the right and left lock portions can be operated synchronously to each other notwithstanding the transmitting member is constructed of a wire.

According to the lock apparatus according to item (20) above, since the operating piece is provided with the tension force adjusting portion for equalizing the tension force of the first wire of the double wire and the tension force of the second wire of the double wire, tension adjusting is possible even after the transmitting portion has been coupled to the instrument panel, so that coupling of the transmitting portion to a vehicle is easy. Therefore, it is not required that a tension force of the first wire and a tension force of the second wire is equalized before the lock apparatus is coupled to the instrument panel.

According to the lock apparatus according to item (21) above, since the tension force adjusting portion includes the aperture formed in the operating piece and the tapered member inserted into the aperture and the aperture is larger in size than the tapered member, the tapered member is allowed to move in the aperture, so that the tension force can be automatically adjusted.

According to the lock apparatus according to item (22) above, since the lock male portion which is a movable portion is supported by the instrument panel, a structure of the glove box can be simplified as compared with a case where the lock male portion is supported by the glove box, so that the housing space in the glove box can be wide.

According to the lock apparatus according to item (23) above, since the lock male portion of the lock portion includes the rotational member and the lock engaging piece axially sliding by rotation of the rotational member, locking and unlocking of the lock portion can be conducted by exchanging a motion of the wire to a reciprocating motion of the lock engaging piece via the rotational member.

According to the lock apparatus according to items (24)-(30) above, the following technical advantages may be obtained in Embodiment 5 of the present invention:

According to the lock apparatus according to item (24) above, since the operating portion includes the operating piece movable in a plane perpendicular to a movement of the knob, and the transmitting portion is adapted to transmit a motion of the operating piece of the operating portion to each of the pair of lock portions allowing an asynchronous transmission to each other, a single wire can be used for the transmitting member of the transmitting portion, so that a freedom of design is increased.

According to the lock apparatus according to item (25) above, since a motion of the operating piece of the operating portion is a linear motion perpendicular to a movement of the knob, the same structure of the operating portion as that of operating portion of Embodiment 2 of the present invention where the transmitting member is a rod can be adopted in Embodiment 5 of the present invention where the transmitting member is a wire.

According to the lock apparatus according to item (26) above, since the transmitting portion is provided to the instrument panel, a structure of the glove box can be simplified as compared with a case where the transmitting portion is supported by the glove box, so that the housing space in the glove box can be wide.

According to the lock apparatus according to item (27) above, since the transmitting portion includes the transmitting member which is a single wire, at least unlocking of the right and left lock portions can be operated synchronously. Locking of the right and left lock portions is not necessarily operated synchronously.

According to the lock apparatus according to item (28) above, since the lock male portion which is a movable member is supported by the instrument panel, a structure of the glove box can be simplified as compared with a case where the lock male portion is supported by the glove box, so that the housing space in the glove box can be wide.

According to the lock apparatus according to item (29) above, since each of the pair of lock portions includes the rotational member supported by the lock casing so as to be linearly slidable in opposite directions and having an inclined groove, and the lock engaging piece having a pin engaging the inclined groove of the rotational member and moving in a direction to and away from the glove box when the rotational member is moved linearly in opposite directions relative to the lock casing, a linear motion of the wire can be easily exchanged to a motion of the lock engaging piece in the direction to and away from the glove box.

According to the lock apparatus according to item (30) above, since the single wire is connected to the rotational member, locking can be released by pulling the lock engaging piece in the direction apart away from the glove box when the knob is pushed.

The invention may be embodied by numerous other devices and methods. The description provided herein, when taken in conjunction with the annexed drawings, discloses examples of the invention. Other embodiments, which incorporate some or all steps as taught herein, are also possible.

BRIEF DESCRIPTION OF THE DRAWINGS

Referring to the drawings, which form apart of this disclosure.

DETAILED DESCRIPTION

Figure 1:
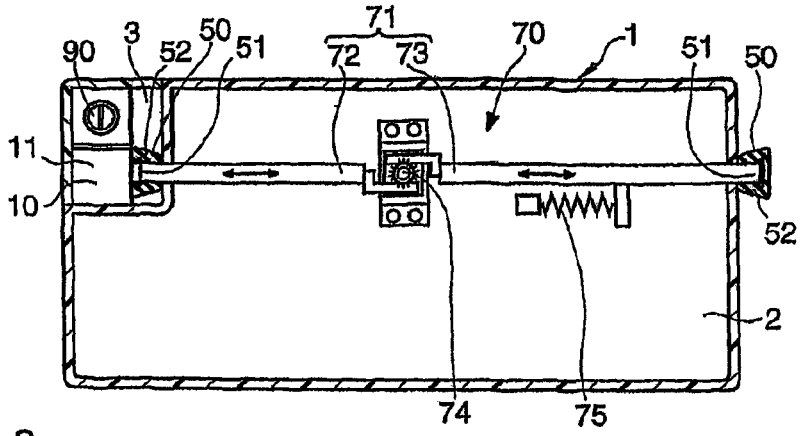
FIG. 1 is a front elevational view of a lock apparatus for locking an opening and closing motion of a glove box according to Embodiment 1 of the present invention (wherein the glove box is shown in a cross section)
Figure 2:
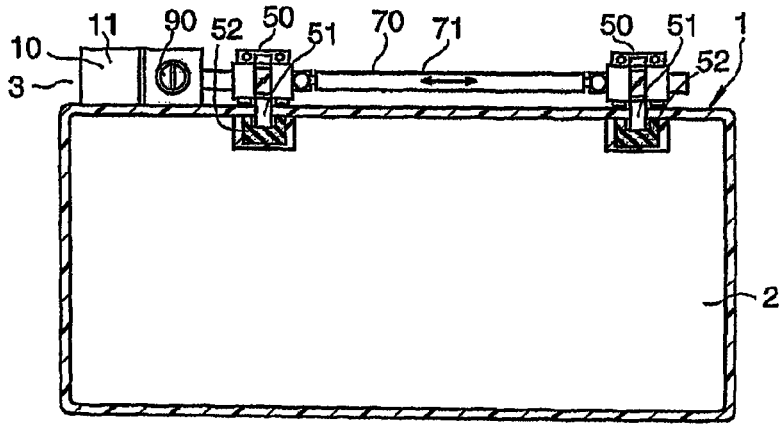
FIG. 2 is a front elevational view of a lock apparatus for locking an opening and closing motion of a glove box according to Embodiment 2 of the present invention (wherein the glove box is shown in a cross section).

A lock apparatus for locking an opening and closing motion of a glove box according to certain embodiments of the present invention will be explained below with reference to FIGS. 1-17.

FIGS. 1-5 illustrate lock apparatuses for locking an opening and closing motion of a glove box according to Embodiments 1-5 of the present invention, respectively. FIGS. 6-17 illustrate structures of parts which can be used to those lock apparatuses. Portions common to or similar to the all embodiments of the present invention are denoted with the same reference numerals throughout the all embodiments of the present invention.

First, structures, operations and technical advantages common to all of the embodiments of the present invention will be explained with reference to, for example, FIGS. 1, 6 and 7.

A lock apparatus 1 for locking an opening and closing motion of a glove box (hereinafter, a lock apparatus 1) according to certain embodiments of the present invention may be an apparatus for locking and unlocking a glove box 2, which is rotatably coupled to a portion of an instrument panel 3 ("the instrument panel" includes "a fixed wall facing a cabin") in front of a passenger seat, to and from the instrument panel 3 when the glove box 2 is at a closed position.

When the lock apparatus 1 is unlocked, the glove box 2 rotates about a rotational axis located at a lower end portion of the glove box by a self gravity of the glove box and opens. When closing the glove box 2, the glove box 2 is raised up manually. When the lock apparatus 1 is locked while the glove box is closed, the glove box 2 continues its closed state.

The lock apparatus 1 includes an operating portion 10, a lock portion 50 and a transmitting portion 70. The lock apparatus 1 may include a key device 90 which is provided adjacent the operating portion 10. The key device 90 may not be provided.

The operating portion 10 is located at a position closer to a driver seat than a central position of the glove box 2 in a right and left direction and is coupled to the instrument panel 3 side between the instrument panel 3 and the glove box 2. The operating portion 10 is provided with a knob 11 of a push type. When pushing the knob 11, lock of the lock apparatus 1 is released and the glove box 2 opens by gravity. When the glove box 2 is raised manually to be rotated and closed, the lock apparatus 1 automatically locks the glove box 2.

The operating portion 10 includes the push-type knob 11, an operating piece 12 movable in a plane perpendicular to a movement of the knob 11, and an exchanging portion 13 for exchanging the movement of the knob 11 to a movement of the operating piece 12. A movement amount of parts (for example, knob 11) is shown by reference symbol "S" in Figures.

Lock portions 50 are provided at opposite end portions of the glove box 2 in the right and left direction, so that a pair of lock portions, i.e., right and left lock portions are provided.

Each of the pair of lock portions 50 includes a lock female portion 52 provided to one of the glove box 2 and the instrument panel 3, and a lock male portion 51 provided to the other of the glove box 2 and the instrument panel 3. The lock male portion 51 is adapted to reciprocally move linearly relative to the lock female portion 52.

The transmitting portion 70 includes a transmitting member 71 and transmits a motion of the operating portion 10 to each of the pair of lock portions 50 using tension and/or compression of the transmitting member 71. The transmitting member 71 does not transmit using a torsion of the transmitting member 71. The transmitting member 71 is made from a rod (which may be a beam) or a wire, etc.

A key device 90 may be provided adjacent the operating portion 10. As illustrated in FIG. 7, the key device 90 includes a stopper 91 which can go in and out from a locus of stroke of the knob 11 and stops a push motion of the knob 11 when the stopper 91 enters the locus of the stroke of the knob 11. The key device 90 includes a key cylinder 92 and a protrusion 93 exchanging a motion of the key cylinder 92 to a movement of the stopper 91.

When key-locking, a key is inserted into the key cylinder 92 and then the key cylinder 92 is rotated. The stopper 91 is pushed by the protrusion 93 of the key cylinder 92, whereby the stopper 91 is moved from a first position 94 to a second position 95 in a direction perpendicular to a stroke of the knob 11 and enters the locus of stroke of the knob 11. As a result, the knob 11 cannot move when the knob 11 is pushed.

When releasing the key-locking so that the knob 11 can be push-stroked, the key is inserted into the key cylinder 92 and then the key cylinder 92 is rotated in reverse direction. The stopper 91 recedes from the position 95 to the position 94, so that the knob 11 can be push-stroked.

Next, operation and technical advantages of the above structures common to all of the embodiments of the present invention will be explained.

(a) Since the knob 11 is disposed at a portion of the instrument panel 3 closer to the driver seat than the center of the glove box 2 in the right and left direction of the glove box, the knob 11 is close to the driver seat and is within a range where a hand of a driver can approach, so that an operability of the knob by the driver is improved.

(b) Since the knob 11 is of a push type, it is easy to operate the knob. Since the knob 11 is not of a rotation type but of a push type, a recess for inserting a finger is not required to be provided in the glove box 2 at a rear of the knob 11. As a result, the appearance of the glove box 2 is good. Further, a thickness of a door of the glove box 2 can be small so that a housing space inside the glove box 2 can be large.

(c) Since the knob 11 is provided to the instrument panel 3, the push direction of the knob 11 and the opening direction of the glove box 2 are not reverse to each other, so that the opening operability of the glove box 2 is improved. If the push direction of the knob 11 and the opening direction of the glove box 2 are reverse to each other, when pushing the knob 11 by a hand, the glove box 2 opens and hits the hand.

(d) Since the lock portions 50 are provided so as to correspond to the right and left end portions of the glove box 2, when closing the glove box 2, a step between the glove box 2 and the instrument panel 3, which would take place due to a deformation of the glove box 2 if the glove box 2 was pushed at only one end of the glove box 2 in the right and left direction of the glove box 2, may not be caused.

(e) Since the transmitting member 71 for transmitting an operating force between the right and left lock portions 50 uses the tension and/or compression of the transmitting member 71, a torsion is not generated in the operating force transmitting member 71, so that motions of the right and left lock portions 50 are synchronized. As a result, notwithstanding the lock portion 50 is provided at each of the right and left ends of the glove box, one side locking of the lock portion 50 due to a torsion of the operating force transmitting member 71 can be prevented, so that a step between the glove box 2 and the instrument panel 3 due to a deformation of the glove box 2 which is likely to happen in the case of one side locking of the lock portion 50 can be prevented.

Further, since the operating portion 10 is provided with the exchanging portion 13 (for example, the exchanging portion having an inclined surface) for exchanging the movement of the knob 11 to a movement of the operating piece 12, a push motion of the knob 11 can be easily exchanged to a stroke motion (e.g., one-dimensional motion such as a linear motion) of the operating piece 12.

Further, since the lock portion 50 includes the lock female portion 52 and the lock male portion 51 which moves linearly relative to the lock female portion 52, the stroke motion of the operating force transmitting member 71 can be exchanged to a motion of the lock male portion 51 of the lock portion 50.

Further, since the key device 90 having a stopper 91 for stopping a push motion of the knob 11 is further provided adjacent the operating portion 10, goods housed in the glove box 2 can be prevented from being stolen by locking the glove box 2 at the closed position by the key device.

Next, structures, operation and technical advantages of portions unique to each or a plurality (but not all) of the embodiments of the present invention will be explained.

Embodiment 1

Figure 6:
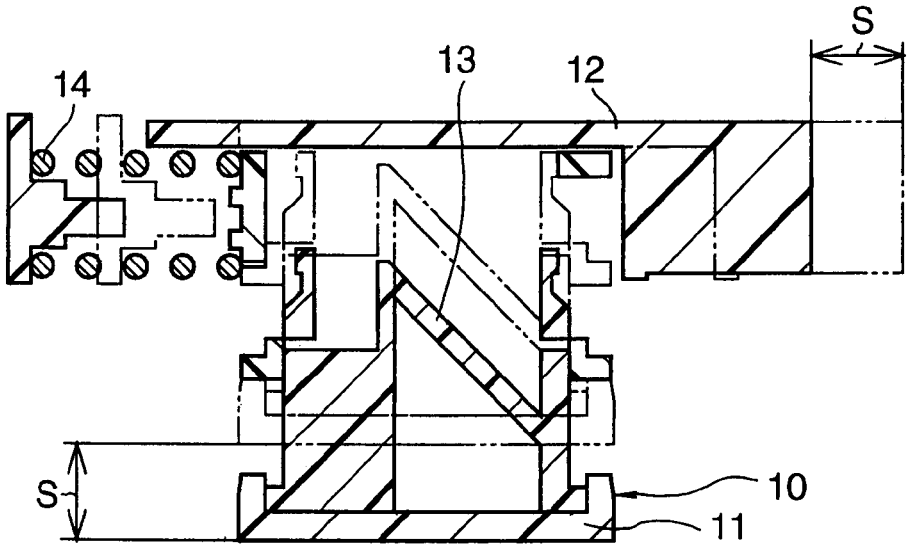
FIG. 6 is a cross-sectional view of an operating portion of the lock apparatus for locking an opening and closing motion of a glove box according to Embodiment 1 of the present invention.
Figure 7:
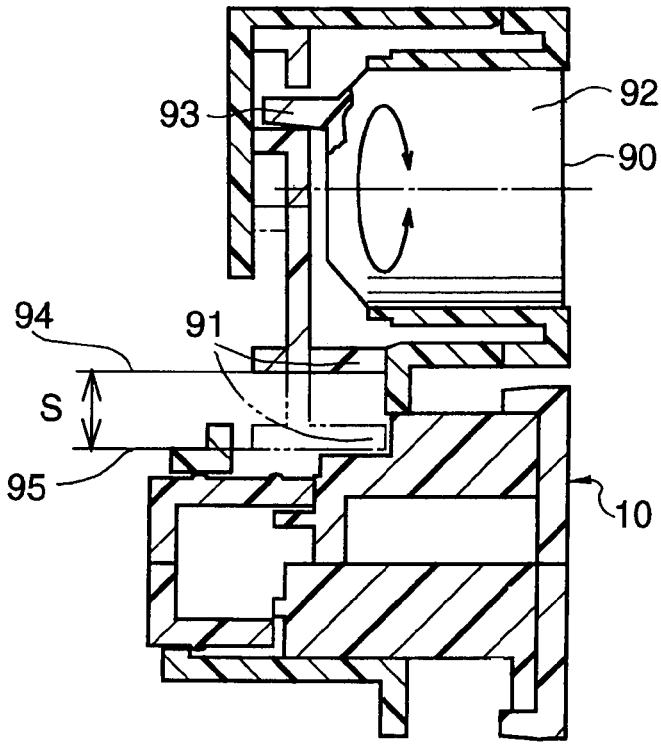
FIG. 7 is a cross-sectional view of an operating portion including a key device, of the lock apparatus for locking an opening and closing motion of a glove box according to Embodiment 1 of the present invention (wherein the key device is applicable to Embodiments 2-5 also.)

FIGS. 1, 6 and 7

In Embodiment 1 of the present invention, as illustrated in FIGS. 1, 6 and 7, the operating portion 10 includes an operating piece 12 movable linearly and reciprocally in a plane perpendicular to a movement of the knob 11. The transmitting portion 70 is adapted to transmit a motion of the operating piece 12 of the operating portion 10 to each of the pair of lock portions 50 synchronously relative to each other.

The operating portion 10 is supported by the instrument panel 3. The exchanging portion 13 of the operating portion 10 includes an inclined plane so that when pushing the knob 11, the knob 11 moves the operating piece 12 toward glove box 2 via the exchanging portion 13, pushing the operating piece 12 in opposition to a biasing force by a pulling spring 14.

The transmitting portion 70 is supported by the glove box 2 between the instrument panel 3 and the glove box 2.

The transmitting portion 70 includes: a first rod 72 supported by the glove box 2 and extending in a right and left direction of the glove box 2; a second rod 73 supported by the glove box 2 and extending in the right and left direction of the glove box 2; and a gear 74 engaging the first rod 72 and the second rod 73 and driving synchronously the first rod 72 and the second rod 73 in opposite directions to each other. A cross-sectional configuration of the first rod 72 and the second rod 73 may be circular or may not be circular. The first rod 72 and the second rod 73 define the transmitting member 71. At least one of the first rod 72 and the second rod 73 is always biased by a spring 75 in a direction where the lock male portion 51 engages the lock female portion 52. When the rod 72 or the rod 73 biased by the spring 75 is pushed by the operating piece 12 during a lock release operation of the lock operating portion 10 and is moved in a lock release direction, engagement of the lock male portion 51 and the lock female portion 52 is disengaged and the lock is released.

The lock male portion 51 of each of the pair of lock portions 50 is supported by the glove box 2 between the instrument panel 3 and the glove box 2, and the lock female portion 52 of each of the pair of lock portions 50 is supported by the instrument panel 3. The lock female portion 52 opposes a side portion of the glove box 2 and includes a grommet.

The lock male portion 51 of the lock portion 50 is formed at each of an end of the first rod 72 and an end of the second rod 73 of the transmitting portion 70. The lock female portion 52 of the lock portion 50 is formed at each of portions of the instrument panel 3 opposing the end of the first rod 72 and the end of the second rod 73 of the transmitting portion 70 in the right and left direction of the glove box 2.

Operation and technical advantages of the apparatus according to Embodiment 1 of the present invention will be explained.

Since the transmitting portion 70 is adapted to transmit a motion of the operating piece 12 of the operating portion 10 to each of the pair of lock portions 50 synchronously relative to each other, locking and/or unlocking of the pair of lock portions 50 synchronize to each other. As a result, one side locking does not occur, and a step, which may be generated between the glove box 2 and the instrument panel 3 in the case of the one side locking when the glove box 2 is pushed at one of the right and left ends of the glove box 2 and is closed, should not be caused.

Since the transmitting portion 70 is supported by the glove box 2, a stroke motion in the right and left direction, of the operating piece of the operating portion 10 can be transmitted to a movement of the transmitting member 71 and then to a movement of the lock male portion 51 of the lock portion 50 maintaining the direction of the motions, i.e., without changing the direction of the motions. As a result, the structures of the transmitting portion 70 and the lock portion 50 can be simplified.

Further, since the first rod 72 and the second rod 73 is operatively coupled to each other via the gear 74, the first rod 72 and the second rod 73 can easily be driven synchronously to each other in opposite directions to each other in the right and left direction of the glove box 2.

Further, since the lock male portion 51 of the lock portion 50 is supported by the glove box 2, the movement of the transmitting member 71 supported by the glove box 2 can be transmitted to a movement of the lock male portion 51 as it is without changing the direction. As a result, the structures of the transmitting portion 70 and the lock portion 50 can be simplified.

Further, since the lock male portions 51 are formed at the end of the first rod 72 and the end of the second rod 73, the movement of the transmitting member 71 is transmitted to a movement of each lock male portion 50 as it is.

Embodiment 2

FIGS. 2, and 8-10

In Embodiment 2 of the present invention, as illustrated in FIGS. 2, and 8-10, the operating portion 10 includes an operating piece 12 movable linearly and reciprocally in a plane perpendicular to a movement of the knob 11. The transmitting portion 70 is adapted to transmit a motion of the operating piece 12 of the operating portion 10 to each of the pair of lock portions 50 synchronously relative to each other.

The operating portion 10 is supported by the instrument panel 3. The exchanging portion 13 of the operating portion 10 includes an inclined plane so that when pushing the knob 11, the knob 11 pulls the operating piece 12 via the exchanging portion 13, pulling an intermediate member 54 of the lock male portion 51 of the lock portion 50 in opposition to a biasing force of the pushing spring 15. The spring 15 always biases the transmitting member 71 of the transmitting portion 70 in a direction pushing the transmitting member.

The transmitting portion 70 is supported by the instrument panel 3 between the instrument panel 3 and glove box 2.

The transmitting portion 70 supported by the instrument panel 3 includes a connecting rod 76 extending in a right and left direction of the instrument panel 3 and spherical joints 77 formed at ends of the connecting rod 76. A cross-sectional configuration of the connecting rod 76 may be circular or may not be circular. The connecting rod 76 and the joint portions 77 define the transmitting member 71. The connecting rod 76 is always pushed by the spring 15 of the operating portion 10. When pushing the knob 11 of the operating portion 10, the connecting rod 76 is pulled whereby lock of the lock portions 50 is released.

The connecting rod 76 connects the lock male portions 51 of the pair of right and left lock portions 50. The connecting rod 76 transmits an operating force by tension and compression of the connecting rod 76.

The lock male portion 51 of each of the pair of lock portions 50 is supported by the instrument panel 3 between the instrument panel 3 and the glove box 2. The lock female portion 52 is supported by the glove box 2 between the instrument panel 3 and the glove box 2. The lock male portion 51 opposes an upper side of the glove box 2. The lock female portion 52 opposes the lock male portion 51 and is provided with a grommet.

Each lock male portion 51 includes a lock casing 53 fixed to the instrument panel 3, an intermediate member 54 supported by the lock casing 53 so as to slidably move in the right and left direction of the instrument panel 3 and having an obliquely extending groove 56, and a lock engaging piece 55 supported by the lock casing 53 so as to slidably move in a direction perpendicular to the direction where the intermediate member 54 moves and having a pin 57 slidably fitting in the groove 56.

When pushing the knob 11 of the operating portion 10, the connecting rod 76 is pulled. The intermediate members 54 of the lock male portions 51 of the right and left lock portions 50 are pulled toward the operating portion 10, and the lock engaging piece 55 is moved in a direction apart away from the upper side of the glove box 2. The lock engaging piece 55 disengages from the lock female portion 52, and lock of the lock portion 50 is released.

Operation and technical advantages of the apparatus according to Embodiment 2 of the present invention will be explained.

Since the transmitting portion 70 is adapted to transmit a motion of the operating piece 12 of the operating portion 10 to each of the pair of lock portions 50 synchronously relative to each other, locking and/or unlocking of the pair of lock portions 50 synchronize to each other. As a result, one side locking does not occur, and a step, which may be generated between the glove box 2 and the instrument panel 3 in the case of the one side locking when the glove box 2 is pushed at one of the right and left ends of the glove box and is closed, is not caused.

Further, since the transmitting portion 70 is supported by the instrument panel 3, the structure of the glove box 2 can be simplified as compared with the case (the case of Embodiment 1) where the transmitting portion 70 is supported by the glove box 2. Further, the housing space of the glove box 2 can be large.

Further, since the transmitting member 71 of the transmitting portion 70 includes the connecting rod 76 extending in the right and left direction of the instrument panel, the right and left lock portions 50 can be operated synchronously by causing the connecting rod 76 to stroke in the right and left direction thereby moving the lock male portion 51 of the lock portion 50 in a direction perpendicular to the stroke of the connecting rod 76.

Further, since the lock male portion 51 includes the lock casing 53 and the lock engaging piece 55, locking and unlocking the lock portion 50 can be conducted by moving the lock engaging piece 55 in a direction toward and away from the lock female portion 52.

Further, since the connecting rod 76 connects the lock male portions 51 of the pair of right and left lock portions 50, locking and unlocking the pair of right and left lock portions 50 can be conducted by moving the connecting rod 76.

Further, since the operating piece 12 of the operating portion 50 is connected to the intermediate member 54 of the lock male portion 51 of the lock portion 50 located closer to the operating portion 10 between the pair of lock portions 50, locking and unlocking the lock portion can be conducted by pushing the knob 11 to move the operating piece, using a small number of members (not via a pivotally supported member unlike the following Embodiment 3 of the present invention).

Embodiment 3

Figure 3:
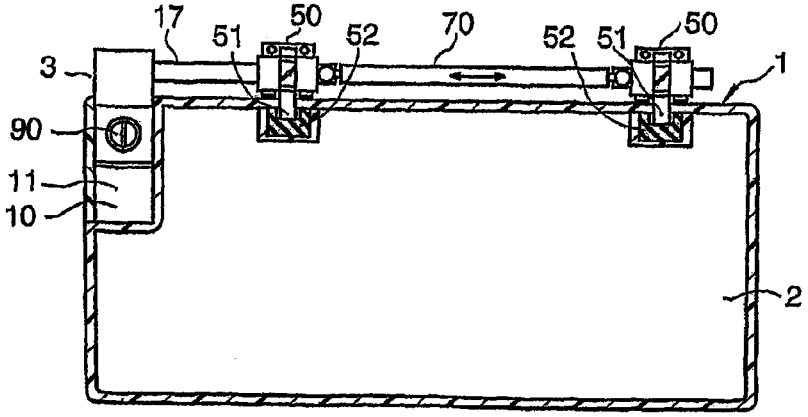
FIG. 3 is a front elevational view of a lock apparatus for locking an opening and closing motion of a glove box according to Embodiment 3 of the present invention (wherein the glove box is shown in a cross section)
Figure 4:
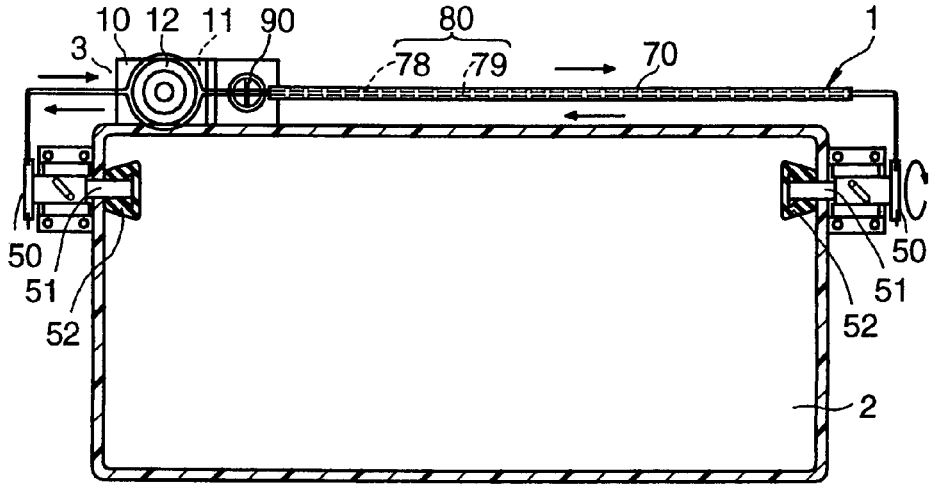
FIG. 4 is a front elevational view of a lock apparatus for locking an opening and closing motion of a glove box according to Embodiment 4 of the present invention (wherein the glove box is shown in a cross section)
Figure 8:
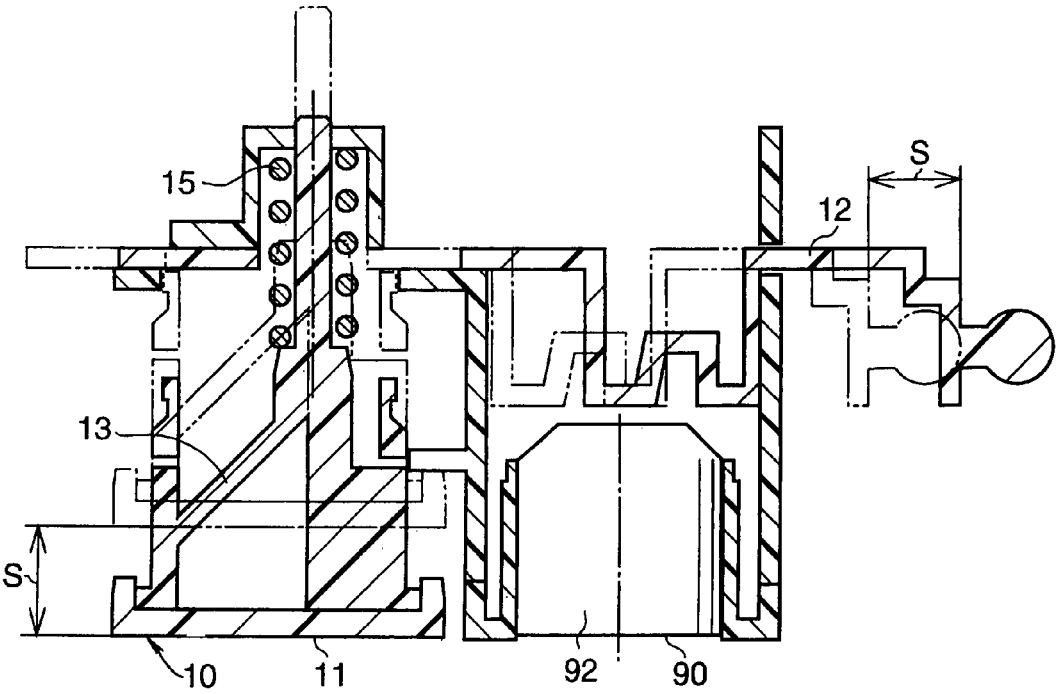
FIG. 8 is a cross-sectional view of an operating portion of a lock apparatus for locking an opening and closing motion of a glove box according to Embodiment 2 (and Embodiment 3, also) of the present invention.

FIGS. 3, and 8-1

Figure 9:
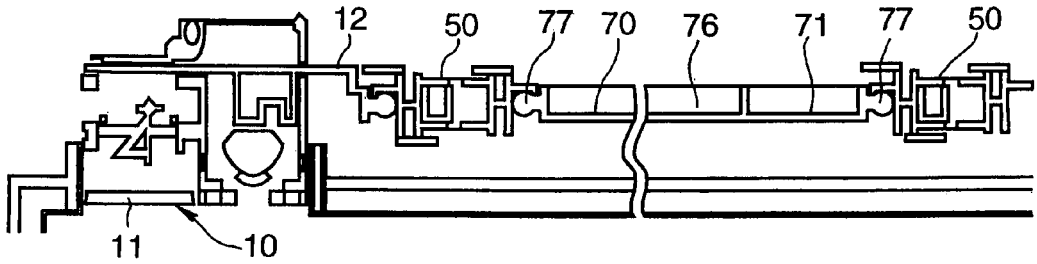
FIG. 9 is a cross-sectional view of a transmitting portion of the lock apparatus for locking an opening and closing motion of a glove box according to Embodiment 2 (and Embodiment 3, also) of the present invention.
Figure 10:
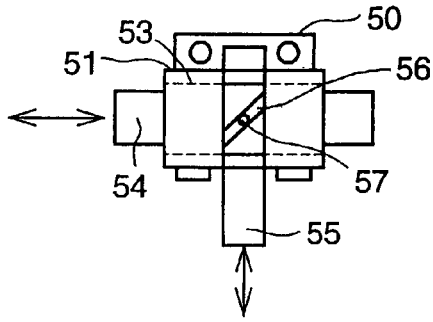
FIG. 10 is a cross-sectional view of a lock portion of the lock apparatus for locking an opening and closing motion of a glove box according to Embodiment 2 (and Embodiment 3, also) of the present invention.
Figure 11:
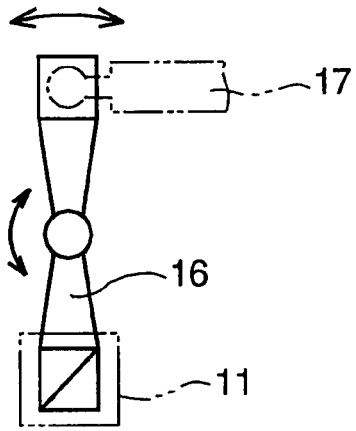
FIG. 11 is a front elevational view of a pivotally supported piece of an operating portion of a lock apparatus for locking an opening and closing motion of a glove box according to Embodiment 3 of the present invention.
Figure 12:
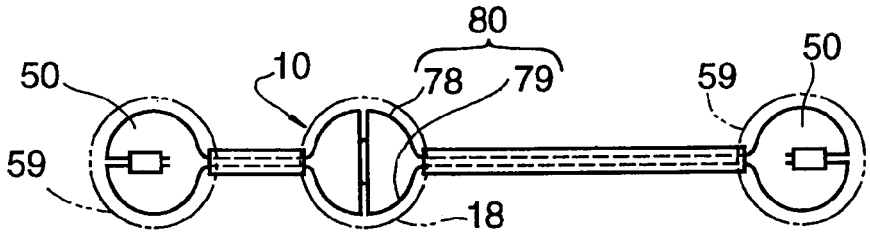
FIG. 12 is a front elevational view of a transmitting member of a lock apparatus for locking an opening and closing motion of a glove box according to Embodiment 4 of the present invention.
Figure 13:
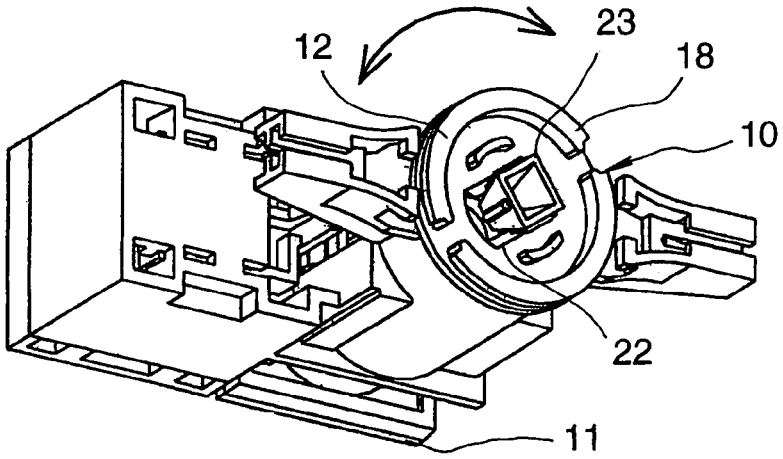
FIG. 13 is a perspective view viewed from a side opposite to a knob, of an operating portion of the lock apparatus for locking an opening and closing motion of a glove box according to Embodiment 4 of the present invention.
Figure 14:
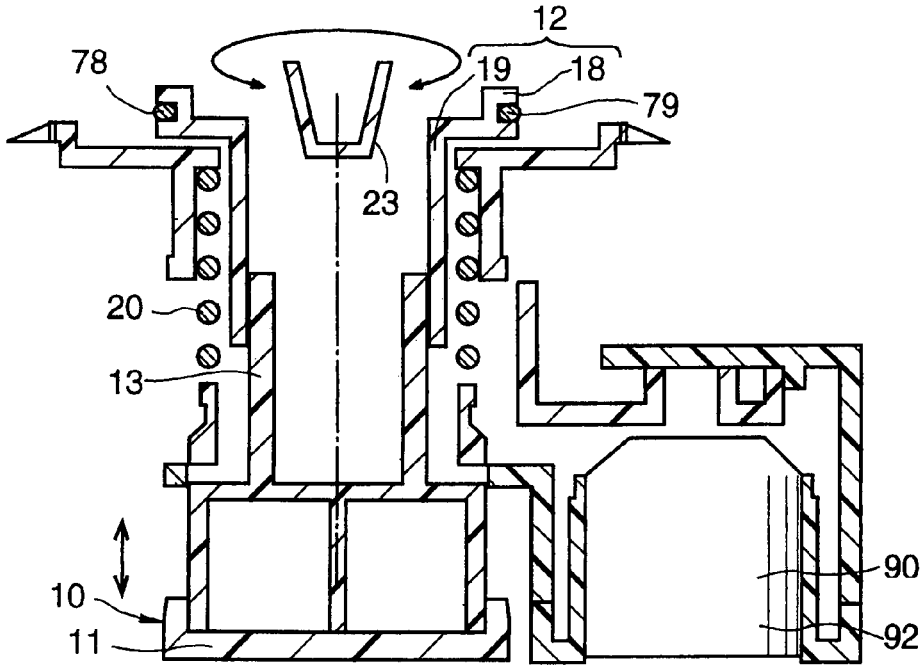
FIG. 14 is a cross-sectional view of the operating portion including a key device, of the lock apparatus for locking an opening and closing motion of a glove box according to Embodiment 4 of the present invention.
Figure 15:
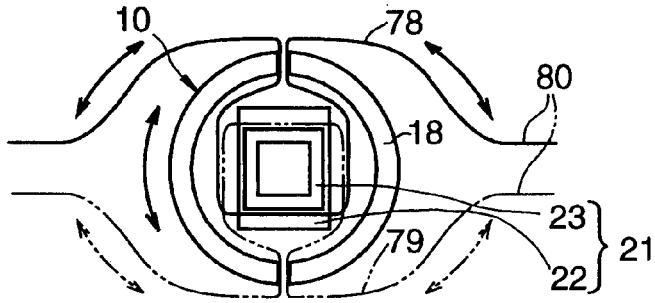
FIG. 15 is a front elevational view viewed from a side of a pulley, of a pulley portion of the operating portion of the lock apparatus for locking an opening and closing motion of a glove box according to Embodiment 4 of the present invention.
Figure 16:
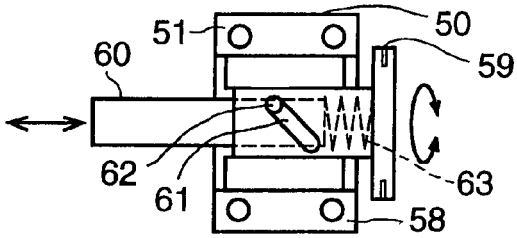
FIG. 16 is a side elevational view of a lock portion of the lock apparatus for locking an opening and closing motion of a glove box according to Embodiment 4 (and Embodiment 5, also) of the present invention.

In Embodiment 3 of the present invention, as illustrated in FIGS. 3, 11, and 8-10 (FIGS. 8-10 are applicable to not only Embodiment 2 but also Embodiment 3), the transmitting portion 70 is adapted to transmit a motion of the operating piece 12 of the operating portion 10 to each of the pair of lock portions 50 synchronously relative to each other.

The operating piece 12 of the operating portion 10 includes a pivotally supported member 16 and a transmitting rod 17 for transmitting a motion of the pivotally supported member 16 to the intermediate member 54 of the lock portion 50.

The pivotally supported member 16 is pivotally supported by the instrument panel 3 so that one end of the pivotally supported member 16 reciprocally and arcuately moves in the right and left direction of the glove box 2. The transmitting rod 17 connects the one end of the pivotally supported member 16 with the intermediate member 54 of the lock male portion 51 of the lock portion 50 located closer to the operating portion 10 between the pair of lock portions 50. At the other end of the pivotally supported member 16, the exchanging portion 13 constructed of an inclined plane is formed for exchanging the stroke motion of the knob 11 to a pivotal motion of the pivotally supported member 16.

The operating portion 10 is supported by the instrument panel 3. When pushing the knob 11 of the operating portion 10, the knob 11 pivots the pivotally supported member 16 via the exchanging portion 13 in opposition to biasing by the pushing spring 15, thereby pulling the transmitting rod 17 and the intermediate member 54 of the lock male portion 51 of the lock portion.

The structures of the transmitting portion 70 and the pair of lock portions 50 of the Embodiment 3 of the present invention are the same as those of the transmitting portion 70 and the pair of lock portions 50 of the Embodiment 2 of the present invention.

Operation and technical advantages of the apparatus according to Embodiment 3 of the present invention will be explained.

Since the transmitting portion 70 is adapted to transmit a motion of the operating piece 12 of the operating portion 10 to each of the pair of lock portions 50 synchronously relative to each other, locking and/or unlocking of the pair of lock portions 50 synchronize to each other. As a result, one side locking does not occur, and a step, which may be generated between the glove box 2 and the instrument panel 3 in the case of the one side locking when the glove box 2 is pushed at one of the right and left ends of the glove box and is closed, is not caused.

Further, since the operating piece 12 of the operating portion 10 includes the pivotally supported member 16, the right and left lock portions 50 can be locked and unlocked by exchanging the pivotal motion of the pivotally supported member 16 to a stroke motion of the intermediate member 54 of the lock male portion 51 of the lock portion 50 by the transmitting rod 17, and by causing the transmitting member 71 to stroke.

Operation and technical advantages of the lock portion 70 and the lock portion 50 of Embodiment 3 of the present invention are the same as those of the lock portion 70 and the lock portion 50 of Embodiment 2 of the present invention.

Embodiment 4

FIGS. 4 and 12-16

In Embodiment 4 of the present invention, as illustrated in FIGS. 4 and 12-16, the operating portion 10 includes an operating piece 12 reciprocally rotatable in a plane perpendicular to a movement of the knob 11. The transmitting portion 70 is adapted to transmit a motion of the operating piece 12 of the operating portion 10 to each of the pair of lock portions 50 synchronously relative to each other.

The operating portion 10 is supported by the instrument panel 3. In Embodiment 4, the operating piece 12 of the operating portion 10 includes a pulley 18 reciprocally rotatable in the plane perpendicular to the movement of the knob 11 and a boss portion 19 integral with the pulley 18.

The exchanging portion 13 for exchanging an operating force, of the operating portion 10 includes a spiral groove. The pushing motion of the knob 11 is exchanged to a rotation of the pulley 18 via the exchanging portion 13. A return spring 20 is provided to the knob 11. When pushing the knob 11, the pulley 12 rotates in one direction, and when releasing a hand from the knob 11, the pulley 12 rotates in the other direction and the knob 11 returns to an original position.

The transmitting portion 70 is provided to the instrument panel 3 between the instrument panel 3 and the glove box 2.

Each of the pair of lock portions 50 includes a lock male portion 51 and a lock female portion 52. The lock male portion 51 of each of the pair of lock portions 50 is supported by the instrument panel 3 between the instrument panel 3 and the glove box 2.

The lock male portion 51 of each of the pair of lock portions 50 includes a lock casing 58, a rotational member 59 including a pulley having an obliquely extending groove 61 and rotatably supported by the lock casing 58, and a lock engaging piece 60 axially slidable to the lock casing 58 and having a pin 62 slidably engaging the obliquely extending groove 61. The lock portion 50 has a spring 63 for rotationally biasing the rotational member 59 or axially biasing the lock engaging piece 60 so that the lock engaging portion 60 is moved toward the lock female portion 52.

The transmitting portion 70 includes a double wire 80 including a first wire 78 and a second wire 79.

The first wire 78 of the double wire 80 is connected to the rotational member 59 of a first lock portion of the pair of lock portions 50. The first wire 78 extends from the first lock portion to the pulley 18 where the first wire 78 is connected to the operating piece pulley 18, and further extends from the pulley 18 to a second lock portion of the pair of lock portions 50 where the first wire 78 is connected to the rotational member 59 of the second lock portion. The second wire 79 of the double wire 80 is connected to the rotational member 59 of the second lock portion of the pair of lock portions 50. The second wire 79 extends from the second lock portion to the pulley 18 where the second wire 79 is connected to the pulley 18, and further extends from the pulley 18 to the first lock portion of the pair of lock portions where the second wire 79 is connected to the rotational member 59 of the first lock portion. When the pulley 18 is rotated, a tension force acting in one direction is loaded on the first wire 78 and another tension force acting in the other direction is loaded on the second wire 79. Tension forces act on the first wire 78 and the second wire 79, and both of the rotational member 59 of the first lock portion and the rotational member 59 of the second lock portion are forcibly rotated, whereby locking and unlocking of the first lock portion and the second lock portion synchronize to each other.

A tension force adjusting portion 21 for adjusting the tension force of the first wire 78 of the double wire 80 and the tension force of the second wire 79 of the double wire 80 and equalizing the tension force of the first wire 78 and the tension force of the second wire 79, is provided to the operating piece 12 of the operating portion 10.

The tension force adjusting portion 21 includes an aperture 22 formed in the pulley 18 of the operating piece 12 between the first wire 78 and the second wire 79 of the double wire 80, and a tapered member 23 inserted into the aperture 22. The aperture 22 is larger in size than the tapered member 23 in a direction where the tapered member 23 is held between the first wire 78 and the second wire 79 so that the tapered member 23 is movable in the aperture 22 in the direction where the tapered member 23 is held between the first wire 78 and the second wire 79 to equalize the tension force of the first wire 78 and the tension force of the second wire 79.

Operation and technical advantages of the apparatus according to Embodiment 4 of the present invention will be explained.

Since a motion of the pulley 18 of the operating piece 12 of the operating portion 10 is rotation in the plane perpendicular to a movement of the knob 11, the push motion of the knob 11 can be exchanged to a pull or a pull motion of the first wire 78 and the second wire 79 of the double wire 80 of the transmitting portion 70 via the pulley 18.

Further, since the transmitting portion 70 is provided to the instrument panel 3, the structure of the glove box 2 can be simplified as compared with a case where the transmitting portion 70 is provided to the glove box 2, so that the housing space in the glove box 2 can be wide.

Further, since the transmitting portion 70 includes the double wire 80 including the first wire 78 and the second wire 79, the right and left lock portions 50 can be operated synchronously to each other notwithstanding the transmitting member 71 is constructed of a wire.

Since the pulley 18 of the operating piece 12 is provided with the tension force adjusting portion 21 for equalizing the tension force of the first wire 78 of the double wire 80 and the tension force of the second wire 79 of the double wire 80, tension adjusting of the wires 78 and 79 is possible even after the transmitting portion 70 has been coupled to the instrument panel 3, so that coupling of the transmitting portion 70 to a vehicle is relatively easy. Therefore, it is not required that a tension force of the first wire 78 and a tension force of the second wire 79 is equalized before the lock apparatus is coupled to the instrument panel 3.

Since the tension force adjusting portion 80 includes the aperture 22 formed in the pulley 18 and the tapered member 23 inserted into the aperture and the aperture is larger in size than the tapered member, the tapered member is allowed to move in the aperture, so that the tension force can be automatically adjusted.

Further, since the lock male portion 51 which is a movable portion is supported by the instrument panel 3, a structure of the glove box 2 can be simplified as compared with a case where the lock male portion 51 is supported by the glove box 2, so that the housing space in the glove box 2 can be wide.

Further, since the lock male portion 51 of the lock portion 50 includes the rotational member 59 and the lock engaging piece 60 axially sliding by rotation of the rotational member 59, locking and unlocking of the lock portion 50 can be conducted by exchanging a motion of the wires 78 and 79 to a reciprocating stroke motion of the lock engaging piece 60 via the rotational member 59.

Embodiment 5

Figure 5:
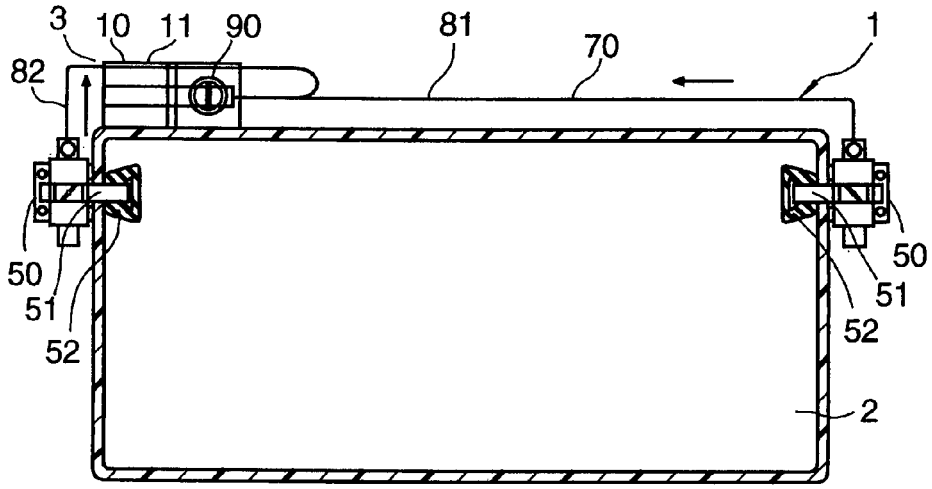
FIG. 5 is a front elevational view of a lock apparatus for locking an opening and closing motion of a glove box according to Embodiment 5 of the present invention (wherein the glove box is shown in a cross section)
Figure 17:
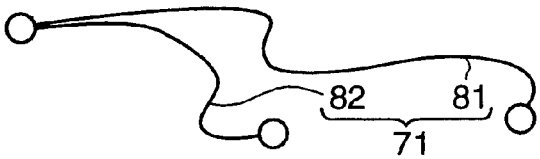
FIG. 17 is a front elevational view of a single wire of a transmitting portion of a lock apparatus for locking an opening and closing motion of a glove box according to Embodiment 5 of the present invention.

FIGS. 5 and 17

In Embodiment 5 of the present invention, as illustrated in FIGS. 5 and 17, the operating portion 10 includes an operating piece 12 reciprocally rotatable in a plane perpendicular to a movement of the knob 11. The transmitting portion 70 is adapted to transmit a motion of the operating piece 12 of the operating portion 10 to each of the pair of lock portions 50 allowing a transmission asynchronous to each other.

A motion of the operating piece 12 of the operating portion 10 is a linear reciprocal motion perpendicular to a movement of the knob 11. The operating portion of the type where when pushing the knob 11, the operating portion pulls the transmitting member 71 of the transmitting portion 70 described in Embodiments 2 and 3 of the present invention can be used as the operating portion 70 of Embodiment 5.

The transmitting portion 70 is provided to the instrument panel 3 between the instrument panel 3 and the glove box 2.

The transmitting portion 70 includes two single wires 81 and 82. Each of the single wires connects each of the pair of lock portions 50 and the operating piece 12 of the operating portion 10. The wire 81 connects the operating piece 12 and the first lock portion 50, and the wire 82 connects the operating piece 12 and the second lock portion 50. The single wires 81 and 82 define the transmitting member 71 in Embodiment 5.

Each of the pair of lock portions 50 includes a lock male portion 51 and a lock female portion 52. The lock male portion 51 of each of the pair of lock portions 50 is supported by the instrument panel 3 between the instrument panel 3 and the glove box 2.

The lock portion having structures similar to those of the lock portion of Embodiment 4 of the present invention can be used for each of the lock portions of Embodiment 5 of the present invention.

More particularly, the lock portion 50 includes a lock casing 58, a rotational member 59 supported by the lock casing 58 so as to be linearly and reciprocally slidable and having an inclined groove 61, and a lock engaging piece 60 having a pin 62 engaging the inclined groove 61 of the rotational member 59 and moving in a direction toward and away from the glove box 2 when the rotational member 59 is moved linearly and reciprocally relative to the lock female portion 52 provided to the lock casing 58. Further, the lock portion 50 includes a spring 63 for rotationally biasing the rotational member 59 or axially biasing the lock engaging piece 60 so that the lock engaging portion 60 moves toward the lock female portion 52.

Since the single wires 81 and 82 are connected to the rotational member 59 of each of the pair of lock portions 50, when the knob 11 of the operating portion 10 is pushed and the operating piece 12 is pulled, the wire pulls the rotational member 59 of the lock portion 50 and pulls the lock engaging piece 60 of the lock portion 50 in a direction away from the glove box 2, thereby releasing lock of the glove box 2 by the lock portion 50.

Operation and technical advantages of Embodiment 5 of the present invention will be explained.

Since the operating portion 70 is adapted to transmit a motion of the operating piece 12 of the operating portion 10 to each of the pair of lock portions 50 allowing an asynchronous transmission to each other, a single wire can be used for the transmitting member 71 of the transmitting portion 70, so that a freedom of design is increased.

According to the lock apparatus according to item (25) above, since a motion of the operating piece of the operating portion is a linear motion perpendicular to a movement of the knob, the same structure of the operating portion as that of operating portion of Embodiment 2 of the present invention where the transmitting member is a rod can be adopted in Embodiment 5 of the present invention where the transmitting member is a wire.

Further, since the transmitting portion 70 is provided to the instrument panel 3, a structure of the glove box 2 can be simplified as compared with a case where the transmitting portion 70 is supported by the glove box 2, so that the housing space in the glove box 2 can be wide.

Further, since the transmitting portion 70 includes the transmitting member 71 which is a single wire 81, 82, at least unlocking of the right and left lock portions 50 can be operated synchronously. Locking of the right and left lock portions 50 is conducted by a biasing force moving the lock engaging piece 60 toward the lock female portion 52 by the spring 63 provided to each lock portion 50. Unless the lock engaging pieces 60 of the right and left lock portions are not coaxial with the opposing lock female portions 52, locking of the right and left lock portions is not necessarily operated synchronously.

Since the lock male portion 51 which is a movable member is supported by the instrument panel 3, a structure of the glove box 2 can be simplified as compared with a case where the lock male portion 51 is supported by the glove box 2, so that the housing space in the glove box 2 can be wide.

Since each of the pair of lock portions 50 includes the rotational member 59 and the lock engaging piece 60 having the pin 62 engaging the oblique groove 61 of the rotational member 59, a linear motion of the wire 81, 82 can be easily exchanged to a reciprocal motion of the lock engaging piece 60.

Since the single wire 81, 82 is connected to the rotational member 59, locking can be released by pulling the lock engaging piece 60 in the direction apart away from the glove box 2 when the knob 11 is pushed.

In Embodiments 1-5 of the present invention, since the pushing motion of the knob 11 of the operating portion 10, the linear and reciprocal motion of the transmitting member 71 of the transmitting portion 70, and the linear and reciprocal motion of the lock engaging piece of the lock male portion 51 of the lock portion 50 are a one-dimensional motion and can take a similar structure to each other, the structures of the operating portions 10 or the lock portions 50 can be standardized and commonly used throughout Embodiments 1-5 of the present invention. By making the structures common to each type of vehicle, cost down can be obtained.

While various embodiments have been described, other embodiments are possible. It should be understood that the foregoing descriptions of various examples of the lock apparatus are not intended to be limiting, and any number of modifications, combinations, and alternatives of the examples may be employed.

The examples described herein are merely illustrative, as numerous other embodiments may be implemented without departing from the spirit and scope of the exemplary embodiments of the present invention. Moreover, while certain features of the invention may be shown on only certain embodiments or configurations, these features may be exchanged, added, and removed from and between the various embodiments or configurations while remaining within the scope of the invention. Likewise, methods described and disclosed may also be performed in various sequences, with some or all of the disclosed steps being performed in a different order than described while still remaining within the spirit and scope of the present invention.

The invention claimed is:

1. A lock apparatus for locking an opening and closing motion of a glove box, the glove box being rotatably coupled to an instrument panel of a vehicle, the apparatus being adapted to lock and unlock rotation of the glove box to and from the instrument panel when the glove box is at a closed position, the apparatus comprising:

an operating portion having a push-type knob, wherein the operating portion is located closer to a driver seat than a right side and center of the glove box in a right and left direction of the vehicle, the operating portion being coupled to an outer surface of the instrument panel between an inner surface of the instrument panel and the glove box;

a pair of lock portions, wherein one of the pair of lock portions is located at a right end portion of the glove box and the other of the pair of lock portions is located at a left end portion of the glove box;

a transmitting portion having a transmitting member defined by a first rod and a second rod supported by the glove box and extending in a right and left direction of the glove box, wherein the transmitting portion is for transmitting a motion of the operating portion to each of the pair of lock portions using tension and compression of the transmitting member, wherein the operating portion includes:

the push-type knob, an operating piece movable in a plane perpendicular to a movement of the knob, and an exchanging portion having an inclined surface for exchanging the movement of the knob to a movement of the operating piece, wherein the pair of lock portions includes:

a lock female portion provided to one of the glove box and the instrument panel; and a lock male portion provided to the other of the glove box and the instrument panel, the lock male portion being adapted to reciprocally move linearly relative to the lock female portion, wherein the transmitting portion is adapted to transmit a motion of the operating piece of the operating portion to each of the pair of lock portions synchronously relative to each other, wherein the transmitting portion is located within and supported by the glove box, wherein the transmitting portion includes:

a gear engaging the first rod and the second rod and driving synchronously the first rod and the second rod in opposite directions to each other, and wherein at least one of the first rod and the second rod is always biased by a spring in a direction where the lock male portion engages the lock female portion, and when the first rod or the second rod biased by the spring is pushed by the operating piece during a lock release operation of the lock operating portion and is moved in a lock release direction, engagement of the lock male portion and the lock female portion is disengaged, and a key device provided adjacent the operating portion, the key device including a key cylinder and a protrusion that, when the key cylinder is rotated, pushes a stopper linearly, in a direction perpendicular to a stroke of the knob, in and out from a locus of the stroke of the knob and stops a push motion of the knob when the stopper enters the locus of the stroke of the knob.

* * * * *

UNITED STATES PATENT AND TRADEMARK OFFICE

CERTIFICATE OF CORRECTION

PATENT NO. : 7,832,239 B2
APPLICATION NO. : 11/795386
DATED : November 16, 2010
INVENTOR(S) : Akihiko Kozuka et al.

It is certified that error appears in the above-identified patent and that said Letters Patent is hereby corrected as shown below:

| Column | Line | |
|---|---|---|
| 16 | 7 | Change "**FIGS. 3**, and **8-1**" to --**FIGS. 3**, and **8-11**--. |

Signed and Sealed this
Third Day of May, 2011

David J. Kappos

David J. Kappos
*Director of the United States Patent and Trademark Office*